United States Patent [19]

Yokoyama

[11] Patent Number: 4,554,783

[45] Date of Patent: Nov. 26, 1985

[54] LINK FOR WATCH BAND AND BRACELET

[75] Inventor: Eisuke Yokoyama, Tokyo, Japan

[73] Assignee: Kawaguchiko Seimitsu Company Limited, Yamanashi, Japan

[21] Appl. No.: 512,706

[22] Filed: Jul. 11, 1983

[30] Foreign Application Priority Data

Jul. 15, 1982 [JP] Japan ..... 57-106401[U]
Jul. 17, 1982 [JP] Japan ..... 57-108318[U]

[51] Int. Cl.[4] ..... F16G 13/00
[52] U.S. Cl. ..... 59/82; D11/13
[58] Field of Search ..... 59/82, 80, 84, 78, 900, 59/901; 63/4, DIG. 3; D11/13, 93; D8/499

[56] References Cited

U.S. PATENT DOCUMENTS 324,582 8/1885 Obrig ..... 59/80
1,205,210 11/1916 House ..... 59/80
2,787,116 4/1957 Anderson ..... D11/93

FOREIGN PATENT DOCUMENTS 345190 4/1960 Switzerland ..... 59/80
6664 1/1980 Switzerland ..... 63/4

*Primary Examiner*—Francis S. Husar
*Assistant Examiner*—Linda McLaughlin
*Attorney, Agent, or Firm*—Koda and Androlia

[57] ABSTRACT

A link for a watch band and a bracelet, comprising a plurality of link elements each having a substantially S-shaped configuration and including a face arm facing a face of the link and having a joining portion and a back arm facing a back of the link and having a joining portion, at least one of the link elements being disposed in a direction opposite to that of the other link elements.

6 Claims, 11 Drawing Figures

LINK FOR WATCH BAND AND BRACELET

BACKGROUND OF THE INVENTION

1. Fields of the Invention

This invention relates to a link for a watch band and a bracelet, and more particularly to a construction of a metal or plastic link in the watch band and the bracelet.

2. Prior Art

The joint constructions of the links of watch bands and bracelets are multifarious and in wide use.

For example, a bracelet according to the prior art includes a plurality of rings connected each other.

Other types of the watch band and the bracelet include a plurality of rings interconnecting links, or intermediate and edge links coupled together by connecting pins or the like.

In the prior arts, the watch bands and bracelets using the rings are fabricated through the step of bending the rings. The step of bending the rings is very troublesome, therefore, it is difficult to mass-produce such watch bands and bracelets.

With the watch band having the connecting pins, it is necessary to form holes in the intermediate and edge links for the insertion of the connecting pins or the like. Materials and shapes of the link in the prior arts are limited for forming precise holes of the links.

SUMMARY OF THE INVENTION

Accordingly, it is the primary object of this invention to provide a link for a watch band and a bracelet which are easily made and assembled without sacrificing a new design.

In keeping with the principles of the present invention, the object is accomplished by a link for a watch band and a bracelet, comprising a plurality of link elements each having a substantially S-shaped configuration and including a face arm facing a face of the link and having a joining portion and a back arm facing a back of the link and having a joining portion, at least one of the link elements being disposed in a direction opposite to that of the other link elements.

BRIEF DESCRIPTION OF THE DRAWINGS

The above-mentioned features and objects of the present invention will become more apparent by reference to the following description taken in conjunction with the accompanying drawings in which.

DETAILED DESCRIPTION OF THE INVENTION

Figure 1:
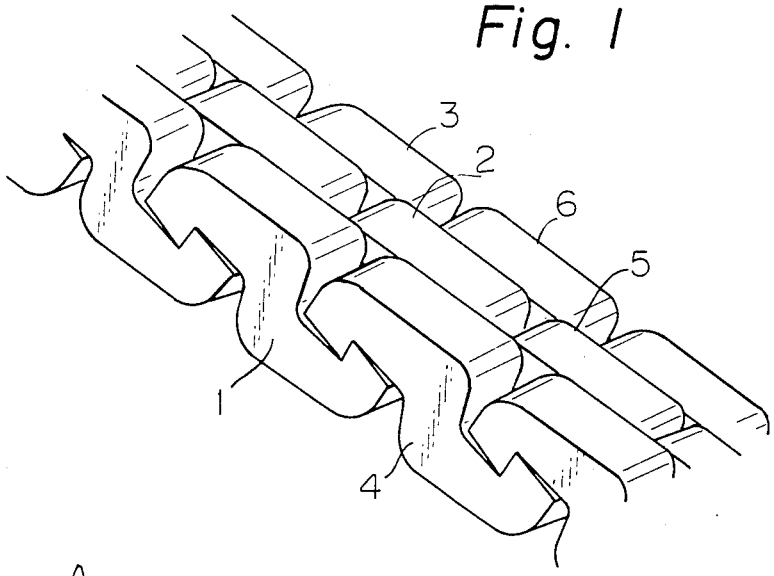
FIG. 1 is a perspective view of one embodiment of connected links according to the present invention.

FIG. 1 is a perspective view of one embodiment of the present invention.

Reference numeral 1 denotes a link element having a substantially S-shaped configuration.

A single link in this embodiment comprises the link element 1 and other link elements 2, 3. Each of the link elements 2, 3 has the same configuration as that of the link element 1. These link elements 1, 2, 3 are made of metal or plastic, and are either joined together or integrally formed with each other.

Link elements 4, 5, 6 are also substantially S-shaped and jointly constitute a single link.

The link including the link elements 1, 2, 3 and the link including the link elements 4, 5, 6 are interconnected with hooks of the link elements 1–6 being held in interlocking engagement with each other.

Figure 2:
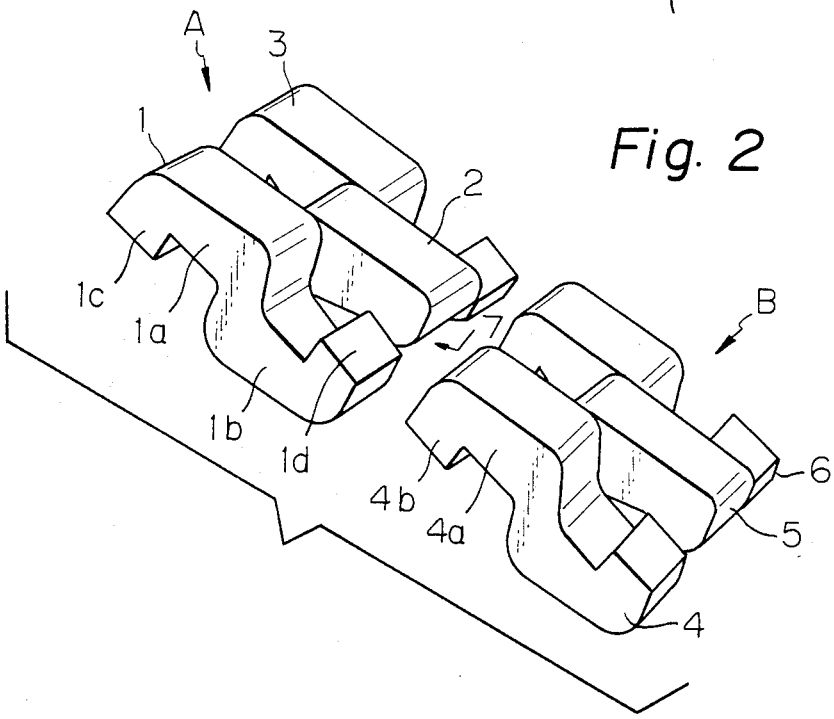
FIG. 2 is a perspective view of the link shown in FIG. 1.
Figure 3:
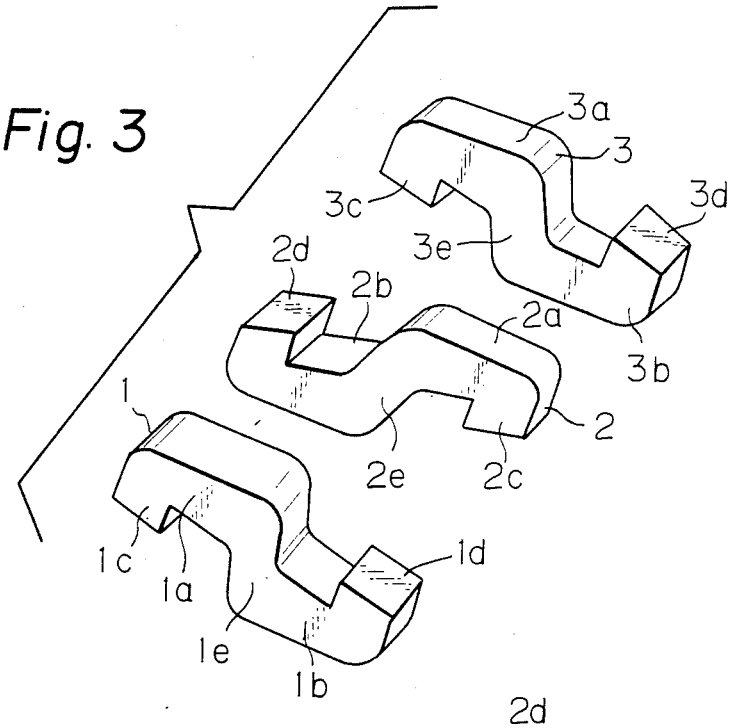
FIG. 3 is a perspective view of link elements illustrated in FIG. 2.

FIG. 2 is a perspective view of the link shown in FIG. 1, and FIG. 3 is a perspective view of the link elements which constitute one of the link shown in FIG. 2.

The link A constructed of the link elements 1, 2, 3 and the link B constructed of the link elements 4, 5, 6 are identical in shape.

In FIG. 3, the link element 1 comprises a face arm 1*a* facing the face of the link A and having a hook 1*c* at the end portion thereof, a back arm 1*b* facing the back of the link A and having a hook 1*d* at the end portion thereof, and an intermediate connecting portion 1*e*. Similarly, the link elements 2 has a face arm 2*a* facing the face of the link A and having a hook 2*c*, a back arm 2*b* facing the back of the link A and having a hook 2*d*, and an intermediate connecting portion 2*e*. Likewise, the link element 3 has a face arm 3*a* facing the face of the link A and having a hook 3*c*, a back arm 3*b* facing the back of the link A and having a hook 3*d*, and an intermediate connecting portion 3*e*.

In the case of forming the link A by joining the link elements 1, 2, 3, the intermediate connecting portion 2*e* is jointed to the intermediate connecting portions 1*e*, 3*e* with the arms 1*a*, 2*b*, 3*a* disposed in one direction and the arms 1*b*, 2*a*, 3*b* disposed in the opposite direction. The link elements 1, 2, 3 may be joined together by adhesive bonding, welding or a screw.

In the case of forming the link A including the link elements 1, 2, 3 as one body, upper and lower molds having mold cavities in the shape of the link A are prepared, and a molten material is poured into the molds to form the link A.

In FIG. 2, when the links A, B are coupled to each other, the link B is moved in the direction of the arrow 7 until a hook 4*b* of the link element 4 abut against the hook 1*d* of the link element 1. At this time, the hooks of the other link elements 2, 3, 5, 6 are also in contact with each other. Then, the link B is pushed further in the direction of the arrow 7 to force the hooks of the link elements 1, 2, 3, 4, 5, 6 to ride over the mating hooks until they are interlocked with each other.

Figure 4:
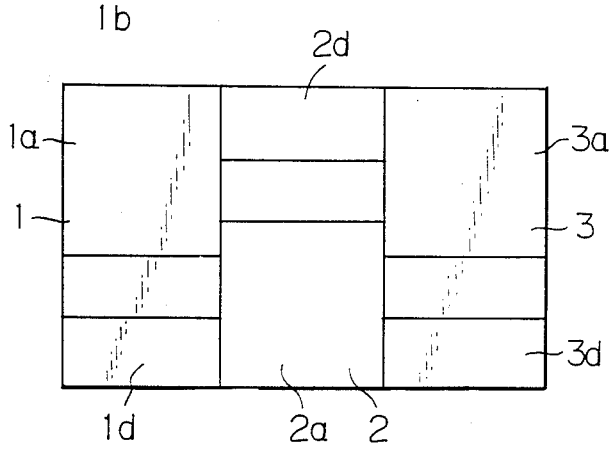
FIG. 4 is a plan view of the link shown in FIG. 2.
Figure 5:
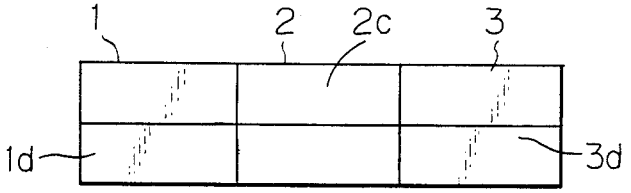
FIG. 5 is a front elevational view of the link shown in FIG. 4.
Figure 6:
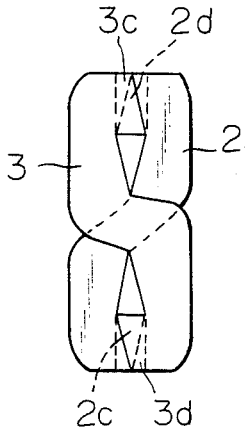
FIG. 6 is a side elevational view of the link shown in FIG. 4.

FIG. 4 is a plan view of the link A shown in FIG. 2, FIG. 5 is a front elevational view of the link A illustrated in FIG. 4, and FIG. 6 is a side elevational view of the link A of FIG. 4.

Figure 7:
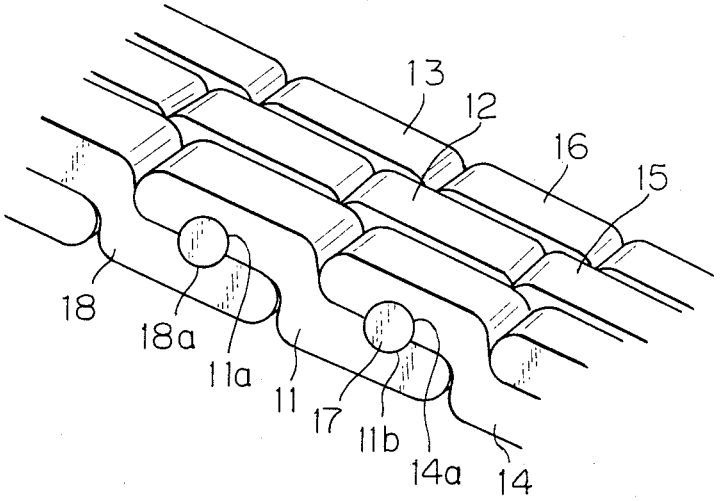
FIG. 7 is a perspective view of an another embodiment of connected links according to the present invention.

FIG. 7 is a perspective view of an another embodiment according to the present invention.

Reference numeral 11 denotes a link element having a substantially S-shaped configuration and semicircular grooves 11*a*, 11*b*. Reference numerals 12, 13 denote link elements each having same shape as the link element 11. A single link in this embodiment is also composed of three link elements 11, 12, 13.

The link including the link elements 11, 12, 13 is connected to the link including link elements 14, 15, 16 by a connecting pin 17. Each link element has semicircular grooves as the grooves 11*a*, 11*b* of the link element 11.

In FIG. 7, the grooves 11*a*, 11*b* are provided on the faces of the link element 11 that contact the link elements 14, 18. These grooves 11*a*, 11*b*, together with respective opposing grooves 14*a*, 18*a* provided on the link elements 14, 18, form through-holes into which the connecting pin 17 is inserted.

Figure 8:
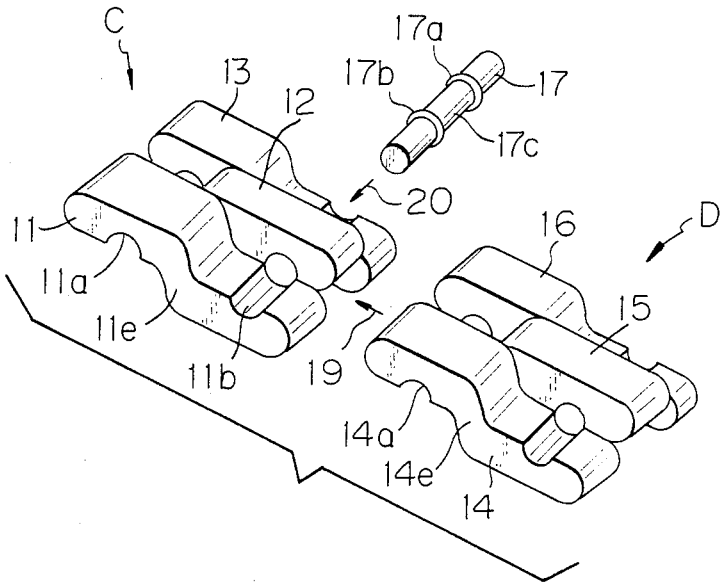
FIG. 8 is a perspective view of the link shown in FIG. 7.
Figure 9:
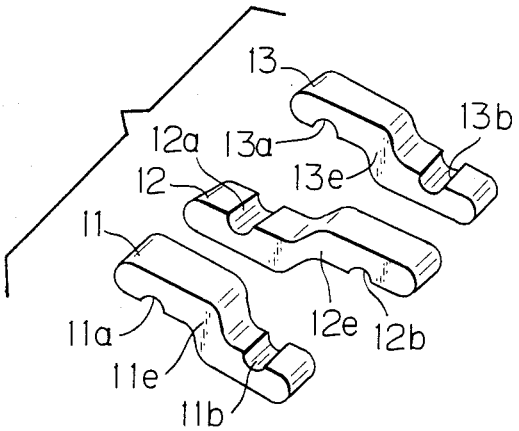
FIG. 9 is a perspective view of link elements illustrated in FIG. 8.

FIG. 8 is a perspective view of the link shown in FIG. 7, and FIG. 9 is a perspective view of the link elements of one of the links shown in FIG. 8.

The link C constructed of the link elements 11, 12, 13 and the link D constructed of the link elements 14, 15, 16 are identically formed in shape.

As best shown in FIG. 9, the substantially S-shaped link elements 11, 12, 13 are joined together or integrally formed with each other.

In the case of forming the link C by joining the link elements 11, 12, 13, the link elements 11, 12, 13 are arranged in a manner that the link elements 11, 13 face in one direction, while the link element 12 faces in the opposite direction.

In this case, the link elements 11, 12, 13 are joined by adhesively bonding, welding or screwing together the adjacent side faces of intermediate connection portions 11*e*, 12*e*, 13*e* thereof.

In the case of forming the link elements 11, 12, 13 as one body, a molten material is poured into a molding cavity defined between closed upper and lower molds, thereby to form the link C.

The links C and D formed as described above are interconnected by fitting the link D onto the link C in the direction indicated by the arrow 19, then the connecting pin 17 is inserted in the direction indicated by the arrow 20. As shown in FIG. 9, the link elements 11, 12, 13 have semicircular grooves 11*a*, 11*b*, 12*a*, 12*b*, 13*a*, 13*b*, respectively. Likewise, the link elements 14, 15, 16 of the link D have semicircular grooves at positions corresponding to the grooves in the link C. As best shown in FIG. 8, when the links C and D are engaged, the groove 11*b* of the link element 11 and the groove 14*a* of the link element 14 cooperate to form through-hole. Likewise, other through-holes are formed between the link elements 12 and 15, and between the link elements 13 and 16. Then the connecting pin 17 is passed through each hole for connecting the links C and D.

The connecting pin 17 has annular projections 17*a*, 17*b*. These annular projections 17*a*, 17*b* are formed integrally with the pin body 17*c*, or are formed by fitting elastic O-rings to the pin body 17*c*. When the connecting pin 17 is inserted in each hole formed between the link elements 11 and 14, etc., the projections 17*a* and 17*b* are pressed through the hole and are closely fitted to the inner surface of the hole. Accordingly, the connecting pin 17 is prevented from falling out from each hole of the links C and D.

Figure 10:
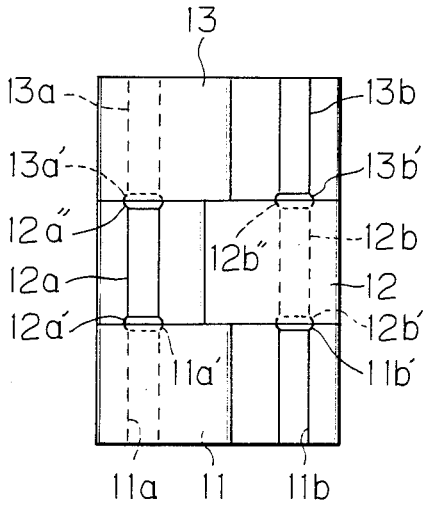
FIG. 10 is a plan view of the link shown in FIG. 8.
Figure 11:
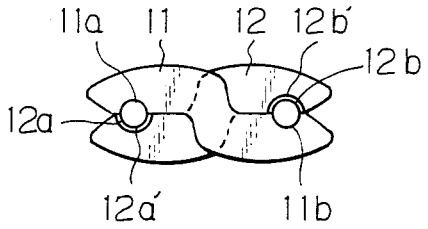
FIG. 11 is a side elevational view of the link shown in FIG. 10.

FIG. 10 is a plan view of the link C shown in FIG. 8, and FIG. 11 is a side elevational view of the link of FIG. 10.

As shown in FIGS. 10 and 11, tapered portions 11*a*′, 11*b*′, 12*a*′, 12*a*″, 12*b*′, 12*b*″, 13*a*′, 13*b*′ are provided at one end of each of the grooves 11*a*, 11*b* of the link element 11, both ends of each of the grooves 12*a*, 12*b* of the link element 12, and one end of each of the grooves 13*a*, 13*b* of the link element 13, respectively. The projections 17*a*, 17*b* of the connecting pin 17 (shown in FIG. 8) are fitted into the annular grooves formed by the tapered portions 1*a*′–3*b*′ in the grooves 1*a*–3*b* of the link elements 1, 2, 3, therefore, the connecting pin 17 is positioned and prevented from falling out.

As described hereinabove, each link of the watch band or bracelet according to the present invention is fabricated by joining or integrally forming a plurality of link elements of the same contour. This link members for the watch band and bracelet can be formed by cutting off a specially profiled bar of substantially S-shaped configuration, or links can be formed by pouring a material into a mold. In particular, when the links are to be integrally formed, upper and lower molds need only be fitted together, there being no need to provide a hole in each link. The mold for integrally forming the links may be a simple mold with no sliding core disposed therein.

The width, number, etc., of the link elements constituting a link can be selected freely providing that the elements are joined or integrally formed in such a manner that two or more link elements of the same shape are joined together, with at least one of the link elements being oriented in a direction opposite to that of the others. For example, there is complete freedom to enlarge the width of the link element 2 in link A of FIG. 2 relative to the other link elements, or to provide further link elements between the link elements 1, 3, with these additional link elements being oriented in the same direction as the link element 2.

Accordingly, it is possible to realize watch bands and bracelets having new designs by means of simple structural elements and a simple connecting structure.

I claim:

1. A link for a watch band and bracelet, comprising:

a plurality of link elements each having a substantially S-shaped configuration and including a face arm facing a face of said link and having a hook provided at the end portion thereof, a back arm facing a back of said link and having a hook provided at the end portion thereof and an intermediate connection portion provided between said face and back arms, wherein said link elements are joined together at said intermediate connecting portions of respective link elements with at least one of said link elements being disposed in a direction opposite to that of the other elements, and wherein said hooks of said face and back arms of said link elements are respectively engaged to hooks of back and face arms of adjacent link elements which are included in adjacent links and are longitudinally aligned in line with said link elements of said link for connecting said link and said adjacent links.

2. A link for a watch band and a bracelet, comprising:

a plurality of link elements each having a substantially S-shaped configuration and including a face arm facing a face of said link and having a hook provided at the end portion thereof, a back arm facing a back of said link and having a hook provided at the end portion thereof and an intermediate connecting portion provided between said face and back arms, wherein said link elements are unified at said intermediate connecting portions of respective link elements with at least one of said link elements being disposed in a direction opposite to that of the other elements, and wherein said hooks of said face and back arms of said link element are respectively engaged to hooks of back and face arms of adjacent link elements which are included in adjacent links and are longitudinally aligned in line with said link elements of said link for connecting said link and said adjacent links.

3. A link for a watch band and a bracelet, comprising: a plurality of link elements each having a substantially S-shaped configuration and including a face arm facing a face of said link and having a groove provided at a lower face thereof, a back arm facing a back of said link and having a groove provided at an upper face thereof and an intermediate connecting portion provided between said face and back arms, wherein at least one of said link elements is disposed in a direction opposite to that of the other link elements, and wherein said grooves of said link element cooperate with grooves of adjacent link elements which are included in adjacent links and are longitudinally aligned in line with said link element of said link in forming through-holes into which connecting pins are respectively inserted for connecting said link and said adjacent links.

4. A link according to claim 3, in which said link elements are joined together at said intermediate connecting portions of respective link elements.

5. A link according to claim 3, in which said link elements are formed as one body which said intermediate connecting portions are connected.

6. A link according to claim 3, in which said connecting pin has at least one annular projection, and in which said link elements have tapered portions provided at ends of said grooves of said link elements, wherein said tapered portions cooperate with tapered portions of transversely adjacent links in forming annular gooves at portions corresponding to said annular projection of said connecting pin being inserted into said through holes.

* * * * *